US012624513B2

(12) United States Patent
Gaylard

(10) Patent No.: US 12,624,513 B2
(45) Date of Patent: May 12, 2026

(54) PILE INSTALLATION APPARATUS AND METHOD OF USE THEREOF

(71) Applicant: Cameron Gaylard, Brendale (AU)

(72) Inventor: Cameron Gaylard, Brendale (AU)

( * ) Notice: Subject to any disclaimer, the term of this patent is extended or adjusted under 35 U.S.C. 154(b) by 105 days.

(21) Appl. No.: 18/698,498

(22) PCT Filed: Oct. 17, 2022

(86) PCT No.: PCT/AU2022/051247

§ 371 (c)(1),
(2) Date: Apr. 4, 2024

(87) PCT Pub. No.: WO2023/064979

PCT Pub. Date: Apr. 27, 2023

(65) Prior Publication Data

US 2024/0344290 A1 Oct. 17, 2024

(30) Foreign Application Priority Data

Oct. 18, 2021 (AU) ..... 2021903347
Oct. 22, 2021 (AU) ..... 2021903395

(51) Int. Cl.
*E02D 13/04* (2006.01)
*E02D 7/22* (2006.01)
*E02D 5/56* (2006.01)

(52) U.S. Cl.
CPC ..... *E02D 13/04* (2013.01); *E02D 7/22* (2013.01); *E02D 5/56* (2013.01)

(58) Field of Classification Search
CPC .... E02D 7/02; E02D 7/06; E02D 7/16; E02D 7/165; E02D 7/22; E02D 13/04
See application file for complete search history.

(56) References Cited

U.S. PATENT DOCUMENTS 11,492,774 B2 * 11/2022 Karkheck ..... E02D 7/26
2020/0032831 A1 1/2020 Almy et al.
(Continued)

FOREIGN PATENT DOCUMENTS

AU 2002217433 A1 * 6/2003 ..... E21B 7/021
CN 118292441 A * 7/2024 ..... G05D 3/12
(Continued)

OTHER PUBLICATIONS

International Search Report (ISR) for PCT/AU2022/051247 mailed Jan. 30, 2023 (6 pages).
(Continued)

*Primary Examiner* — Frederick L Lagman
(74) *Attorney, Agent, or Firm* — Shumaker, Loop & Kendrick, LLP

(57) ABSTRACT

A pile installation apparatus and method of use thereof is provided for loading and installing a pile into an underlying ground surface. In one form, the pile installation includes: a mast; a vehicle mount for mounting the mast to a support vehicle; a carriage and drive assembly rotatably coupled to the mast and configured for vertical movement along the mast, said assembly including a rotational drive and drive shaft for mounting of a drive end of the pile thereon. The carriage and drive assembly configured to be rotatable relative to the mast between a loading position for loading a non-vertically oriented pile onto the drive shaft and an operable position for driving the pile into the underlying ground surface.

17 Claims, 15 Drawing Sheets

(56) References Cited

U.S. PATENT DOCUMENTS

| | | | | |
|---|---|---|---|---|
| 2020/0217034 | A1 | 7/2020 | Karkheck et al. | |
| 2024/0110356 | A1* | 4/2024 | Watts | E02D 13/00 |
| 2024/0426071 | A1* | 12/2024 | Plotkin | E02D 5/56 |

FOREIGN PATENT DOCUMENTS

| | | | | | |
|---|---|---|---|---|---|
| EP | 3584370 | A1 * | 12/2019 | | E02D 7/06 |
| GB | 2166781 | A * | 5/1986 | | E02D 7/16 |
| JP | S-5184106 | A | 7/1976 | | |
| JP | 3856564 | B | 12/2006 | | |
| KR | 100882538 | B1 * | 2/2009 | | E02D 3/123 |
| WO | WO-2023060316 | A1 * | 4/2023 | | E02D 7/22 |

OTHER PUBLICATIONS

Written Opinion (WO) for PCT/AU2022/051247 mailed Jan. 30, 2023 (6 pages).

* cited by examiner

PILE INSTALLATION APPARATUS AND METHOD OF USE THEREOF

TECHNICAL FIELD

The present invention relates to a pile installation apparatus and method of use thereof for loading and installing a pile into an underlying ground surface.

BACKGROUND

Screw piles are a screw-in piling used for building foundations in the construction of buildings and other structures. A typical screw pile is formed from high-strength steel and includes a shaft having an insertion end portion and an opposed drive end portion. The insertion end portion usually includes one or more helical screws or blades extending outwardly therefrom.

In order to insert a screw pile into a ground surface, the pile is mounted to drilling equipment supported by a support vehicle and is rotated and pressed downwardly so as to cause the one or more helical screws or blades to bite and screw into the ground. Once properly inserted, the weight borne by the screw pile is distributed from the helical screw or blade onto underlying earth and the earth positioned above the helical screw or blade assists the pile in resisting any lifting forces applied to the pile and in maintaining the screw pile in the ground.

However, a problem in general with the screw pile installation process is that each pile is manually mounted onto the drilling equipment. Apart from posing a significant safety risk, the manual mounting process is both labour and time consuming, often involving a team of labourers to handle, align and slide the screw pile in place on the drilling equipment.

The above problem is further emphasised on remote work sites where a plurality of screw piles need to be installed, such as, e.g., solar energy installations. The additional cost of having a team of labourers present at a remote work site to handle and mount each screw pile can be prohibitive.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a pile installation apparatus and method of use thereof, which may at least partially address one or more of the problems or deficiencies mentioned above or which may provide the public with a useful or commercial choice.

According to a first aspect of the present invention, there is provided a pile installation apparatus for loading and installing a pile into an underlying ground surface, said apparatus including:

- a mast adapted to be arranged in a substantially vertical position above the ground surface;
- a vehicle mount for mounting the mast to a support vehicle adapted to raise and lower the mast to and from the substantially vertical position and to otherwise manipulate and transport the mast;
- a carriage and drive assembly slidably mounted to the mast for vertical movement therealong and configured for rotational movement relative to the mast, said assembly including a rotational drive and drive shaft for mounting of a drive end of the pile thereon, said carriage and drive assembly configured to be rotatable relative to the mast between a loading position for loading a non-vertically oriented pile onto the drive shaft and an operable position for driving the pile into the underlying ground surface; and
- at least one clamping assembly including a pair of opposed clamping members for clamping the drive end of the pile and retaining the pile relative to the drive shaft at least while the carriage and drive assembly rotates to the operable position.

According to a second aspect of the present invention, there is provided a carriage and drive assembly for use with the pile installation apparatus of the first aspect, said assembly slidably mounted to the mast for vertical movement therealong and configured for rotational movement relative to the mast, said assembly including a rotational drive and a drive shaft for mounting of a drive end of a pile thereon, said carriage and drive assembly configured to be rotatable relative to the mast between a loading position for loading a non-vertically oriented pile onto the drive shaft and an operable position for driving the pile into the underlying ground surface.

According to a third aspect of the present invention, there is provided a clamping assembly for use with the pile installation apparatus of the first aspect, said clamping assembly including a pair of opposed clamping members for clamping a drive end of a pile and retaining the pile relative to the drive shaft at least while the carriage and drive assembly rotate to an operable position.

Advantageously, the pile installation apparatus of the present invention provides a safe and efficient way to individually load and install screw piles. The mast and carriage and drive assembly enable piles to be loaded from a horizontal resting position, such as, e.g., on a rack, and be mounted relative to the drive shaft without the need for any manual labour other than an operator of the support vehicle.

As indicated above, the pile installation apparatus of the present invention is configured to be mounted to a support vehicle for the loading and installation of piles, preferably screw piles. It will therefore be convenience to hereinafter describe the apparatus with reference to this example application. However, a person skilled in the art will appreciate that the apparatus is capable of broader applications and may be use in any application involving the repeated handling and vertical orientation of vertical support members, such as, e.g., columns, utility poles and the like.

The pile may preferably be a screw pile.

The screw pile may include a hollow shaft having an insertion end configured for insertion into a ground substrate and an opposed drive end configured to be coupled to a drive assembly.

In some embodiments, the insertion end may include a screw or one or more blades or plates extending outwardly therefrom for screwing of the pile into the ground substrate. In such embodiments, the entire screw pile may rotate when torque is applied via the drive shaft.

In other embodiments, the screw pile may include a hollow shaft and a lower portion having a screw or one or more blades or plates extending outwardly therefrom coupled to the hollow shaft for screwing of the pile into the ground substrate. The hollow shaft and the lower portion may be rotatably coupled together. The lower portion may rotate independently of the hollow shaft.

The hollow shaft of the pile may have a polygonal cross-sectional shape, typically rectangular.

In some embodiments, the pile may further include a hub configured to engage with a drive shaft of the carriage and drive assembly.

The hub may be located within the hollow shaft and/or the lower portion, typically the lower portion.

The hub may define a shaped opening for at least partially receiving the drive shaft, preferably a drive socket. In use, the hub may rotate together with the drive shaft to apply torque to at least the lower portion of the pile.

In preferred embodiments, the hub may be rotatable relative to the hollow shaft of the pile and may be fixed against rotation relative to the lower portion. That is, the hollow shaft may be fixed against rotation and the lower portion may rotate together with the drive shaft via the hub when torque is applied.

The mast of the apparatus of the present invention may be of any suitable size, shape and construction. Typically, the mast may be formed of metal, preferably steel with a high tensile strength grade.

The mast may include a pair of opposed ends and an elongate body extending therebetween, typically in a linear direction. The opposed ends may include a lower end and an opposed upper end.

The elongate body of the mast may typically be of a height to support a screw pile in a substantially vertical orientation above a ground surface.

In some embodiments, the mast be formed from a beam.

In other embodiments, the mast may be formed from two or more longitudinally extending frame members joined together by a plurality of cross frame members.

The elongate body of the mast may be defined by at least four walls. The at least four walls may include a support vehicle facing wall, an opposed carriage and drive assembly wall and opposed sidewalls.

As indicated, apparatus includes a vehicle mount for mounting the mast to a support vehicle.

The support vehicle may be of any suitable size shape and form adapted to raise and lower the mast to and from the substantially vertical position and to otherwise manipulate and transport the mast.

The support vehicle may preferably include a boom configured to be coupled to the mast for raising and lowering and otherwise manipulating the mast. The boom may include one or more articulations and one or more linear actuators for at least pivoting the boom upwards and downwards relative to a remainder of the vehicle.

In preferred embodiments, the support vehicle may include a hydraulic excavator.

The vehicle mount may be of any suitable size, shape and construction for releasably mounting to the support vehicle, preferably to a remote end of the boom.

For example, in some embodiments, the vehicle mount may include a quick coupler for attachment to a remote end of a boom of the support vehicle. Of course, a skilled person will appreciate that any suitable vehicle mount known in the art for releasably mounting the mast relative to the support vehicle may be used.

The vehicle mount may be located on the support vehicle facing wall of the mast, typically within a lower half of the mast.

As indicated, the apparatus includes a carriage and drive assembly slidably mounted to the mast for vertical movement therealong and configured for rotational movement relative to the mast.

The assembly may include a carriage configured to be slidably mountable to the mast and a drive mount rotatably coupled to the carriage for mounting the rotational drive and drive shaft thereon.

The carriage may include a platform to which the drive mount is rotatably coupled.

The platform may include a pair of opposed surfaces interconnected by opposing edges. The opposed surfaces may include an outer surface and an opposed inner surface. The opposing edges may include opposed end edges and opposed side edges extending longitudinally between the opposed end edges.

The carriage and the mast may be slidably mounted together in any suitable way.

For example, in some embodiments, the mast may include a rail extending at least partially along a height of the mast to which the carriage is slidably mounted.

The rail may include any form of guided or directional conveyance. For example, the rail may include a track.

In preferred embodiments, the carriage may include one or more roller assemblies and the mast may include at least one guide track extending at least partially along a height of the carriage and drive assembly wall of the mast for guiding passage of the roller assemblies of the carriage therealong.

The one or more roller assemblies may be arranged in any suitable arrangement along the opposed side edges of the platform.

Each guide track may include at least one channel for guiding passage of a respective roller assembly. The channel may be of a suitable cross sectional shape to facilitate movement of the roller assemblies along the channel but prevent lateral movement or separation of the roller assemblies away from the channel.

Each guide track may be integrally formed with or mounted to the carriage and drive assembly wall of the mast.

The apparatus may further include an actuating mechanism for moving the carriage back-and-forth along a height of the mast. Any suitable type of actuating mechanism may be used.

For example, the actuating mechanism may include one or more of a linear actuators, such as, e.g., a pneumatic ram, a hydraulic ram or rigid chain actuator (also known as a linear chain actuator, a push-pull actuator, an electric chain actuator, a zip chain actuator or a column forming actuator).

In other embodiments, the actuating mechanism may include a servomotor or stepper motor configured to slide the carriage along the mast.

In yet other embodiments, the actuating mechanism may include a hydraulically-, pneumatically-, or electrically-powered screw jack or screw motor.

In further embodiments, the actuating mechanism may include a hydraulically-, pneumatically-, or electrically-powered rack-and-pinion.

In yet further embodiments, the actuating mechanism may include a drive motor, such as, e.g., an electric or hydraulic motor or combustion engine operatively associated with a drive chain, winch or cable for moving the carriage along the mast.

As indicated, the carriage and drive assembly may include a drive mount for mounting the rotational drive thereon.

The drive mount may be rotatably coupled to the platform of the carriage by a rotational coupling such that the drive mount may swivel about a horizontal axis relative to the carriage.

The rotational coupling may be of any suitable form known in the art. For example, in some embodiments the rotational coupling may include a turntable bearing.

The rotational coupling may enable the drive mount to be rotatable relative to the carriage over any suitable range of rotation between orientations at least corresponding to the loading position and the operable position. For example, the rotational coupling may enable the drive to be rotatable about a horizontal axis at least 90°, at least 95°, at least 100°, at least 105°, at least 110°, at least 115°, at least 120°, at least 125°, at least 130°, at least 135°, at least 140°, at least 145°, at least 150°, at least 155°, at least 160°, at least 165°, at least 170°, at least 175°, at least 180° or even more.

Like the carriage, the rotational coupling may include an actuating mechanism for rotating the drive mount relative to the carriage. Any suitable type of actuating mechanism may be used.

In some embodiment, the actuating mechanism may include a drive motor, such as, e.g., an electric motor, a hydraulic motor or a combustion engine operatively associated with a first part of the rotational coupling for rotating a second part of the rotational coupling relative to the first part.

In other embodiments, the actuating mechanism may include one or more linear actuators as previously described. Reciprocating movement of the linear actuators between extended and retracted positions may impart rotational movement to part of the rotational coupling relative to the other part for rotating at least the drive mount relative to the carriage.

The drive mount may be of any suitable size, shape and construction for mounting the rotational drive relative to the assembly. Generally, the drive mount may include one or more brackets for holding and anchoring the rotational drive relative to the assembly.

The rotational drive may include a drive motor and a formation for releasably engaging with and rotating the drive shaft.

The formation may typically have a polygonal cross-sectional shape, preferably rectangular.

The drive motor may be an electric motor, a hydraulic motor or a combustion engine.

The drive shaft may be of any suitable size and shape to transmit torque from the formation to at least the insertion end or lower portion of the pile, preferably via the hub.

Generally, the drive shaft may be an elongate member having a pair of opposed ends.

The pair of opposed ends may include an upper end configured to mount to the formation and an opposed lower end configured to engage with the hub of the pile, preferably to thereby in use transmit torque to at least the lower portion of the pile, more preferably while torque is not transmitted to a remainder of the pile.

In preferred embodiments, the assembly may further include a slide assembly between the rotational coupling and the drive mount. The slide assembly may enable the drive mount to be slidable relative to a remainder of the carriage and drive assembly between an extended and retracted position.

Advantageously, in use the slide assembly may enable the drive shaft to be extended outwards relative to a remainder of the carriage and drive assembly for loading of a pile thereon, preferably for at least partial insertion of a remote, or distal, end of the drive shaft into the drive end of the pile.

The slide assembly may enable the drive mount (and the rotational drive and drive shaft mounted thereon) to slide over any suitable distance between the extended and retracted positions relative to a remainder of the carriage and drive assembly. For example, the side assembly may enable the drive mount to slide outwards relative to a remainder of the carriage and drive assembly a distance of about 100 mm, about 200 mm, about 300 mm, about 400 mm, about 500 mm, about 600 mm, about 700 mm, about 800 mm, about 900 mm, about 1,000 mm, about 1,100 mm, about 1,200 mm, about 1,300 mm, about 1,400 mm, or even about 1,500 mm, typically about 600 mm.

The slide assembly may include a sliding platform on which the drive mount is mounted. The sliding platform may be slidably mounted to a part or portion of the rotational coupling.

The sliding platform and the part or portion of the rotational coupling may be slidably mounted together in any suitable way known in the art.

For example, in some embodiments the part or portion of the rotational coupling may include at least one shaped groove or channel extending linearly at least partially along the part or portion and the sliding platform may be slidably mounted to the at least one shaped groove or channel, preferably by a roller or plain bearing assembly configured to be retainable and slidable within the shaped groove or channel.

In other embodiments, the part or portion of the rotational coupling may include a rail for guided or directional conveyance of the sliding platform as previously described.

In yet other embodiments, the part or portion of the rotational coupling may include at least one guide track as previously described and the slidable platform may include one or more roller or plain bearing assemblies for slidably mounting in the at least one guide track.

The slide assembly may further include an actuating mechanism for moving the slide platform of the slide assembly between the extended and retracted positions. Any suitable type of actuating mechanism may be used.

For example, and as previously described, the actuating mechanism may include one or more linear actuators, servomotor or stepper motor arrangement, a power screw jack or screw motor or a drive chain, winch or cable and drive motor arrangement.

Preferably, the actuating mechanism may include one or more linear actuators, preferably hydraulic rams for driving movement of the sliding platform of the sliding assembly between the extended and retracted positions.

As indicated, the apparatus may include at least one clamping assembly for clamping about the drive end of the pile.

In some embodiments, the at least one clamping assembly may be for clamping onto a drive end of a pile for mounting onto the drive shaft and for holding onto the pile while it is driven into the underlying ground surface.

Additionally, and/or in other embodiments, the at least one clamping assembly may be for retaining the pile relative to the drive shaft at least while the carriage and drive assembly rotate to the operable position.

The clamping assembly may be operatively associated with the carriage and drive assembly in any suitable way.

In some embodiments, the clamping assembly may be mounted to the drive mount.

In other embodiments, the clamping assembly may be indirectly mounted to the drive mount via a telescopic arm. This will be described in detail later.

The clamping assembly may include the pair of opposed clamping members, a clamping housing for at least partially housing and holding the clamping members relative to one another and mounting the assembly to the carriage and drive assembly and an actuating mechanism for moving the opposed clamping members towards and away from one another.

Each clamping member may include a plate including a clamping surface sized and shaped to fit at least partially about a periphery of the drive end of the pile. In preferred embodiments, the clamping surface may be shaped to complementarily fit at least partially about a periphery of the drive end of the pile.

In some embodiments, the clamping surface of each clamping member may include a pad, liner or coating applied thereon for at least partially assisting in gripping and holding the drive end of the pile. The pad, liner or coating may be of any suitable size, shape and form.

Typically, the pad, liner or coating may be formed from a resiliently deformable material or materials, such as, e.g., rubber or soft plastic material or materials.

In some embodiments, the clamping assembly may further include at least one impact plate and damper for damping an impact of the pile when it is partially inverted and allowed to slide onto the drive shaft, typically under the force of gravity.

The at least one impact plate may be mounted on a surface of the clamping housing facing a distal end of the drive shaft, preferably a lower surface.

The damper may typically be located between the impact plate and the lower face for damping a force of the impact. The damper may include a telescopic damper, a rubber damper and/or a spring, such as, e.g., a coil spring.

Any suitable type of actuating mechanism may be used for moving the clamping members towards and away from one another.

Generally, the actuating mechanism may include one or more actuators. Typically, the one or more actuators may include one or more linear actuators each capable of moving between an extended position and a retracted position for driving movement of the clamping members relative to each other.

The one or more linear actuators may include any one of a pneumatic ram, a hydraulic ram or a rigid chain actuator, preferably a hydraulic ram.

In preferred embodiments, the at least one clamping assembly may be operatively associated with the drive mount and the carriage and drive assembly by way of a telescopic arm configured to be moveable between extended and retracted positions relative to the drive mount and the carriage and drive assembly.

The telescopic arm may be of any suitable construction.

Typically, the telescopic arm may include an outer telescopic member mounted to the drive mount and an inner telescopic member configured to be received through and be moveable relative to the outer telescopic member between the extended and retracted positions.

The outer telescopic member may define a conduit with a passageway extending therethrough through which the inner telescopic member is received.

The inner telescopic member may include a pair of opposed end and an elongate body extending therebetween, typically in a linear direction.

The at least one clamping assembly may be mounted on one of the opposed ends so as to be moveable relative to the drive mount and the carriage and drive assembly when the inner telescopic member is slid relative to the outer telescopic member.

In use, the telescopic arm may advantageously move to the extended position together with the clamping assembly for receiving and clamping about the drive end of a pile for mounting the pile onto the drive shaft. The telescopic arm may then move to the retracted position together with the at least one clamping assembly and the clamped pile to guide the pile onto the drive shaft, preferably fully onto the drive shaft.

In embodiments in which the clamping assembly further includes at least one impact plate and damper, the movement of the telescopic arm to the extended position may position the at least one impact plate and damper in front of the carriage and drive assembly for receiving a pile thereon when mounting the pile onto the drive shaft.

Like the clamping assembly, the telescopic arm may include an actuating mechanism for moving the inner telescopic member and the at least one clamping assembly mounted thereon between the extended and retracted positions.

In some embodiments, the actuating mechanism may include one or more actuators, preferably linear actuators each capable of moving between an extended position and a retracted position for driving movement of the telescopic arm between the extended and retracted positions, preferably for driving movement of the inner telescopic member relative to the outer telescopic member.

Again, the one or more linear actuators may include any one of a pneumatic ram, a hydraulic ram or a rigid chain actuator, preferably a hydraulic ram.

In other embodiments, the actuating mechanism may include a hydraulically-, pneumatically-, or electrically-powered rack-and-pinion mechanism.

Preferably, the telescopic arm may be capable of moving the clamping assembly beyond a distal end of the drive shaft for guiding and mounting a pile thereon.

In some embodiments, the apparatus may further include a drive shaft guide operatively associated with telescopic arm and/or the clamping assembly, preferably mounted to the telescopic arm.

The drive shaft guide may extend out from an end of the inner telescopic member adjacent the clamping assembly for aligning the drive shaft relative to the clamping assembly when the clamping assembly retracts relative to the drive mount via the telescopic arm to mount a pile on the drive shaft.

The drive shaft guide may include a collar through which the drive shaft may extend and at least one arm extending between the collar and the end of the inner telescopic member.

The collar may include one or more plain bearings applied on an inner surface to facilitate movement of the drive shaft therethrough.

In some embodiments, the apparatus may further include at least one guide assembly for at least partially enclosing around a periphery of the pile at or near the lower end of the mast and guiding the pile as it is driven into the underlying ground surface.

The guide assembly may include a pair of opposed guide members hingedly connected to the mast and pivotable relative to the mast and an actuating mechanism for moving the guide members towards and away from each other.

In use, the guide assembly may be configured to at least partially enclose the pile while driving the pile into the underlying ground surface for guiding the pile relative to the mast.

Advantageously, the opposed guide members may temporarily pivot away from each other to allow passage of the screw or one or more blades or plates extending outwardly from the insertion end or lower portion of the pile.

Each guide member may again include a shaped internal guiding surface configured to complementarily fit at least partially about a periphery of the pile. The guiding surface may include one or more plain bearings applied thereon.

Any suitable actuating mechanism may be used for moving the clamping members towards and away from one another.

Generally, the actuating mechanism may include one or more actuators, typically one or more linear actuators each capable of moving between an extended position and a retracted position for driving movement of the clamping members relative to each other.

The one or more linear actuators may include any one of a pneumatic ram, a hydraulic ram or a rigid chain actuator, preferably a hydraulic ram.

In some embodiments, the apparatus may include an onboard controller for controlling operation of the apparatus, including the various actuating mechanisms, for loading and driving a screw pile.

The controller may preferably be a microcomputer, including one or more processors and a memory. The processor may include multiple inputs and outputs coupled to components of the apparatus.

In some embodiments, the apparatus may further include a remote controller for controlling operation of the apparatus, preferably via the onboard controller.

The remote controller and the onboard controller may be in communication over a wired or wireless network.

For example, in some such embodiments, the remote controller may be operatively associated with the support vehicle and may be in communication with the onboard controller over a wired network.

The remote controller may include one or more keys, buttons and/or switches for a user to control operation of the apparatus.

The remote controller may include at least one display. The at least one display may display operational data and/or positional data transmitted by the onboard controller.

In some embodiments, the remote controller may include a microcomputer, including one or more processors and a memory.

In other embodiments, the remote controller may be in the form of a computing device, such as, e.g., a desktop or laptop. In such embodiments, the remote controller may further include software configured to run on the computing device. The software may preferably be interactive to allow a user to interact and control the apparatus.

In yet other embodiments, the remote controller may be in the form of a mobile computing device, such as, e.g., a smart phone, a tablet or smart watch. In such embodiments, the remote controller may again further include software in the form of an application (i.e., an app) configured to be run on the mobile computing device and allow a user to interact and control operation of the apparatus.

According to a fourth aspect of the present invention, there is provided a method of loading a pile with an apparatus according to the first aspect, said method including:

moving the carriage and drive assembly relative to the mast so that the drive shaft aligns with a drive end of the pile;

extending the at least one clamping assembly relative to the carriage and drive assembly so that the at least one clamping assembly extends beyond a distal end of the drive shaft;

clamping the drive end of the pile with the at least one clamping assembly;

retracting the at least one clamping assembly relative to the carriage and drive assembly to mount a clamped said pile onto the drive shaft; and rotating the carriage and drive assembly relative to the mast to the operable position.

According to a fifth aspect of the present invention, there is provided a method of loading a pile with an apparatus according to the first aspect, said method including:

moving the carriage and drive assembly relative to the mast so that the drive shaft aligns with a drive end of the pile;

extending the drive shaft until it is at least partially received in the drive end of the pile;

partially inverting the pile on the drive shaft to mount the pile thereon; and clamping the drive end of the pile relative to the drive shaft with the at least one clamping assembly for retaining the pile relative to the drive shaft while the carriage and drive assembly rotate to the operable position.

The methods may include one or more features or characteristics of the apparatus, and assemblies as hereinbefore described.

Generally, the methods may be for loading a non-vertically oriented pile onto a drive shaft of the carriage and drive assembly and then moving the carriage and drive assembly together with the driver shaft and the pile mounted thereon into an operable position for driving the pile into an underlying ground surface.

The non-vertically oriented pile may be resting in a rack or atop a trailer, typically in a horizontal orientation.

The moving may include sliding the carriage of the carriage and drive assembly along the mast and rotating the drive mount (and mounted rotational drive and drive shaft) to align the drive shaft relative to the drive end of the pile.

In some embodiments, the extending may include sliding the rotational drive and drive shaft relative to the rotational coupling with the slide assembly to partially insert the drive shaft into the drive end of the pile.

The clamping may include actuating the opposed clamping members to clamp the drive end of the pile.

In some embodiments, the clamping may be for retrieving the clamped said pile and mounting it on the drive shaft.

Additionally, and/or in other embodiments, the clamping may be for retaining the pile relative to the drive shaft while the carriage and drive assembly rotate to the operable position, and preferably while the pile is driven into the underlying ground surface.

In embodiments according to the fifth aspect, the partially inverting may include rotating the rotational drive, the drive shaft and the pile partially mounted thereon relative to a remainder of the carriage to slide the pile substantially onto the drive shaft, preferably under the force of gravity.

In such embodiments, the drive shaft may typically be rotated to an angle of between about 100° and about 170° relative to a horizontal plane to encourage the pile slidably mount on the drive shaft.

In preferred such embodiments, the partially inverting may initially include positioning the at least one impact plate and damper relative to the rotational drive for damping an impact of the pile when it is partially inverted and slides under the force of gravity substantially onto the drive shaft.

In some embodiments, the rotating the carriage and drive assembly relative to the mast to the operable position may additionally include moving the carriage and drive assembly upwards towards or near an upper end of the mast so as to provide clearance for the pile mounted on the drive shaft to be rotated together with the carriage and drive assembly to the operable position.

In some embodiments, the method may further include guiding a lower end of the pile relative to the mast with at least one guide assembly. The guide assembly may be configured to at least partially enclose about the pile when moving the carriage and drive assembly from the loading position to the operable position and when driving the pile into the underlying ground surface for guiding the pile relative to the mast.

Advantageously, the opposed guide members of the guide assembly may temporarily pivot away from each other to allow passage of the screw or one or more blades or plates extending outwardly from the insertion end or lower portion of the pile when being driven into the underlying ground surface.

Any of the features described herein can be combined in any combination with any one or more of the other features described herein within the scope of the invention.

The reference to any prior art in this specification is not and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

DETAILED DESCRIPTION

FIGS. 1 to 13 show embodiments of a pile installation apparatus (100) and parts thereof for loading and installing a screw pile (700) into an underlying ground surface.

FIGS. 1 to 7 show a first embodiment of the pile installation apparatus (100).

Figure 1:
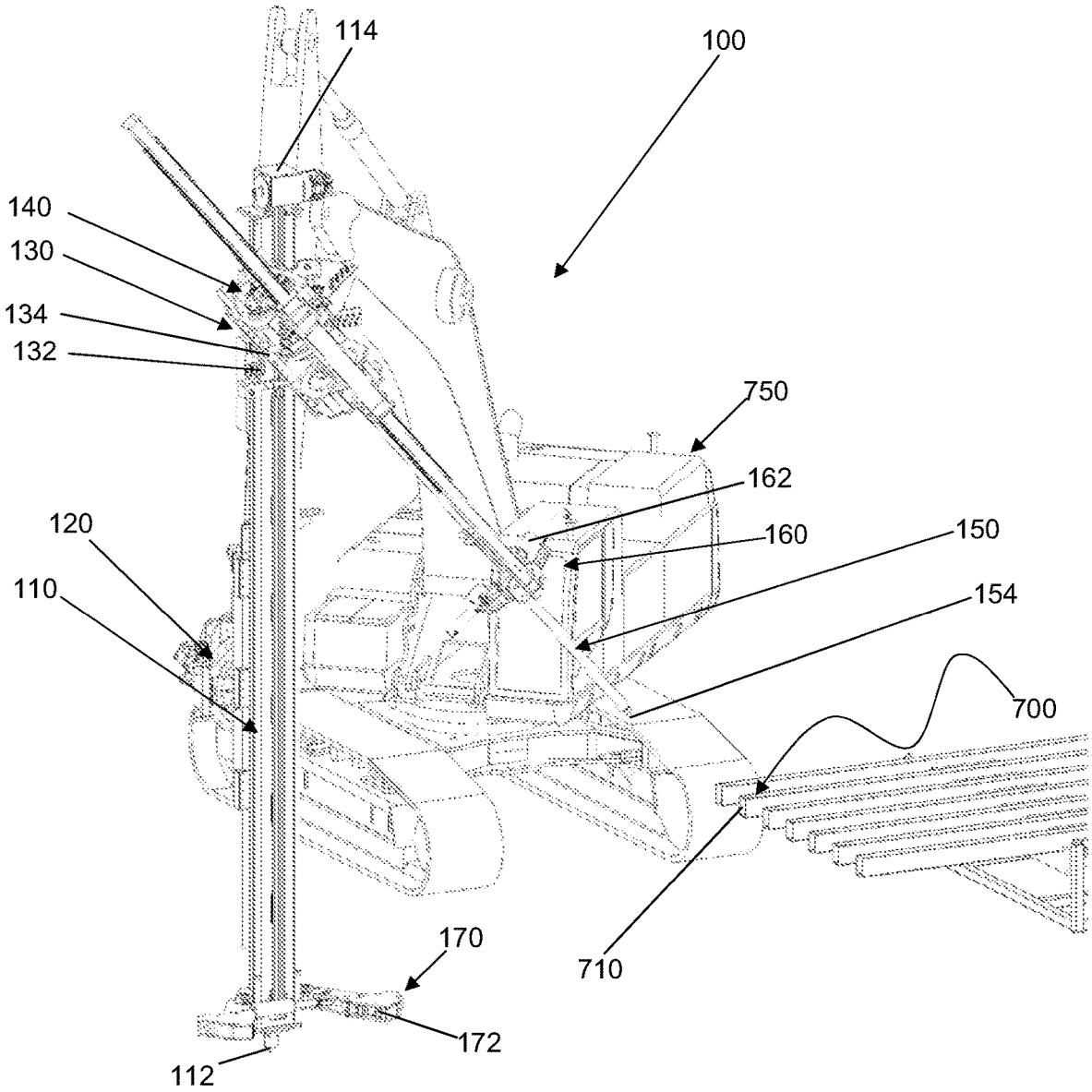
FIG. 1 is a photograph of a pile installation apparatus according to an embodiment of the present invention.

Referring to FIG. 1, the apparatus (100) includes a mast (110) adapted to be arranged in a substantially vertical position above a ground surface; a vehicle mount (120) for mounting the mast (110) to an excavator (750) adapted to raise and lower the mast (110) to and from the substantially vertical position and to otherwise manipulate and transport the mast (110) and apparatus (100); and a carriage and drive assembly (130) slidably mounted to the mast (110) for movement therealong and configured for rotational movement relative to the mast (110), said assembly (130) including a rotational drive (140) and drive shaft (150) for mounting of a drive end (710) of a screw pile (700) thereon, said carriage and drive assembly (130) configured to be rotatable relative to the mast (110) between a loading position for loading a non-vertically oriented pile (700) onto the drive shaft (150) and an operable position for driving the pile (700) into an underlying ground surface.

The apparatus (100) further includes a clamping assembly (160) including a pair of opposed clamping members (162) for clamping the drive end (710) of the pile (700) for mounting onto the drive shaft (150) and retaining the pile (700) relative to the drive shaft (150) at least while the carriage and drive assembly (130) rotate to the operable position; and a guide assembly (170) including a pair of opposed guide members (172) for at least partially enclosing around a periphery of the pile (700) at or near the lower end of the mast (110) and guiding the pile (700) as it is driven into the underlying ground surface.

The mast (110) is of a height to support a screw pile (700) in a substantially vertical orientation above a ground surface.

The mast (110) is in the form of a beam and is formed from steel with a high tensile strength grade.

The mast (110) includes a pair of opposed ends and an elongate body extending therebetween in a linear direction. The opposed ends include a lower end (112) and an opposed upper end (114).

The mast (110) includes a support vehicle facing wall, an opposed carriage and drive assembly wall and opposed sidewalls.

Figure 5:
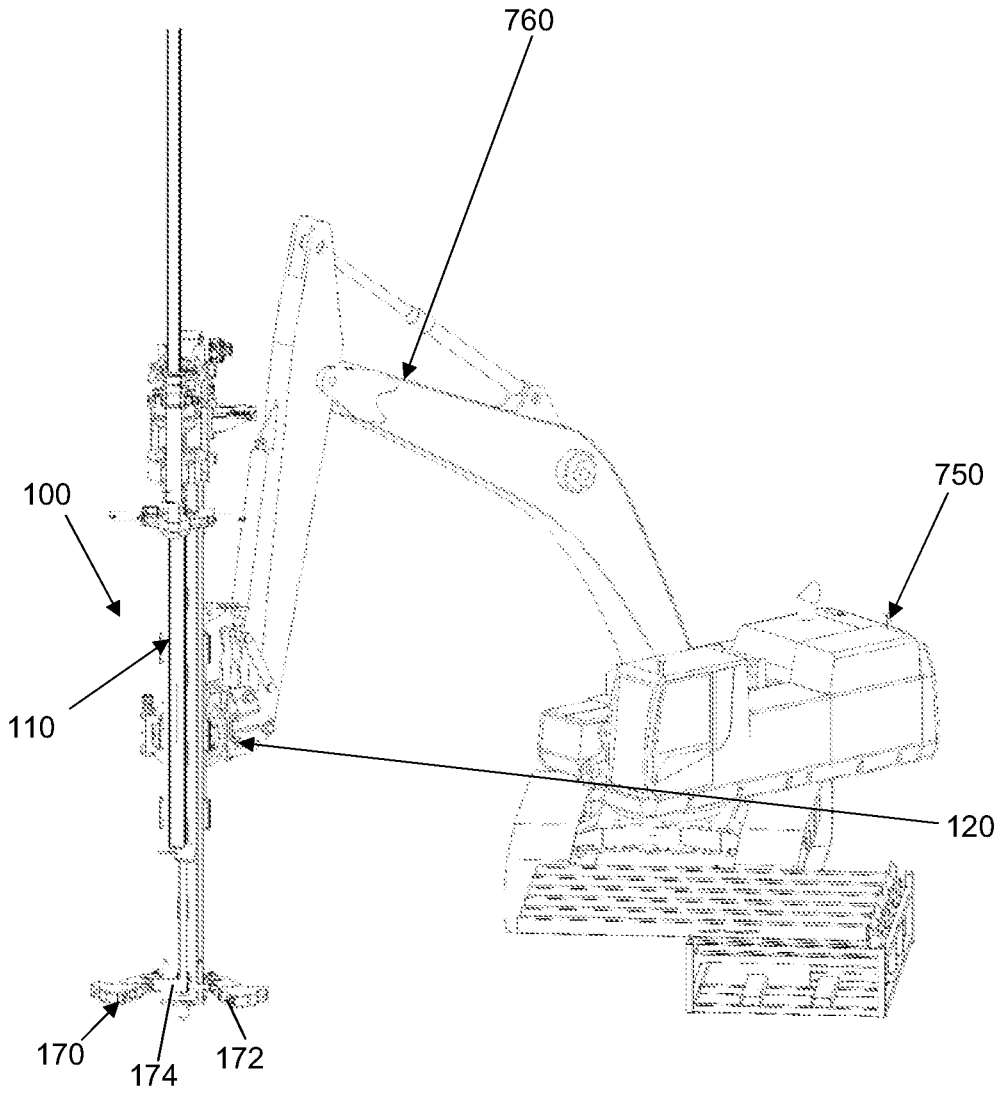
FIG. 5 is a photograph of the pile installation apparatus as shown in FIG. 1 to 4 with the drive shaft and the pile mounted thereon rotated back to a substantially vertical orientation for driving of the pile into an underlying ground surface.

Referring briefly to FIG. 5, the vehicle mount (120) is a quick coupler for attachment of the apparatus (100) to a remote end of a boom (760) of an excavator (750).

The vehicle mount (120) is located on the support vehicle facing wall of the mast (110) within a lower half of the mast (110).

Referring back to FIG. 1, the carriage and drive assembly (130) is slidably mounted to the mast (110) for movement therealong and configured for rotational movement relative to the mast (110).

The assembly (130) includes a carriage (132) configured to be slidably mountable to the mast (110) and a drive mount (134) rotatably coupled to the carriage (132) by a rotational coupling (136; not visible) for mounting the rotational drive (140) with operable drive shaft (150).

Figure 6:
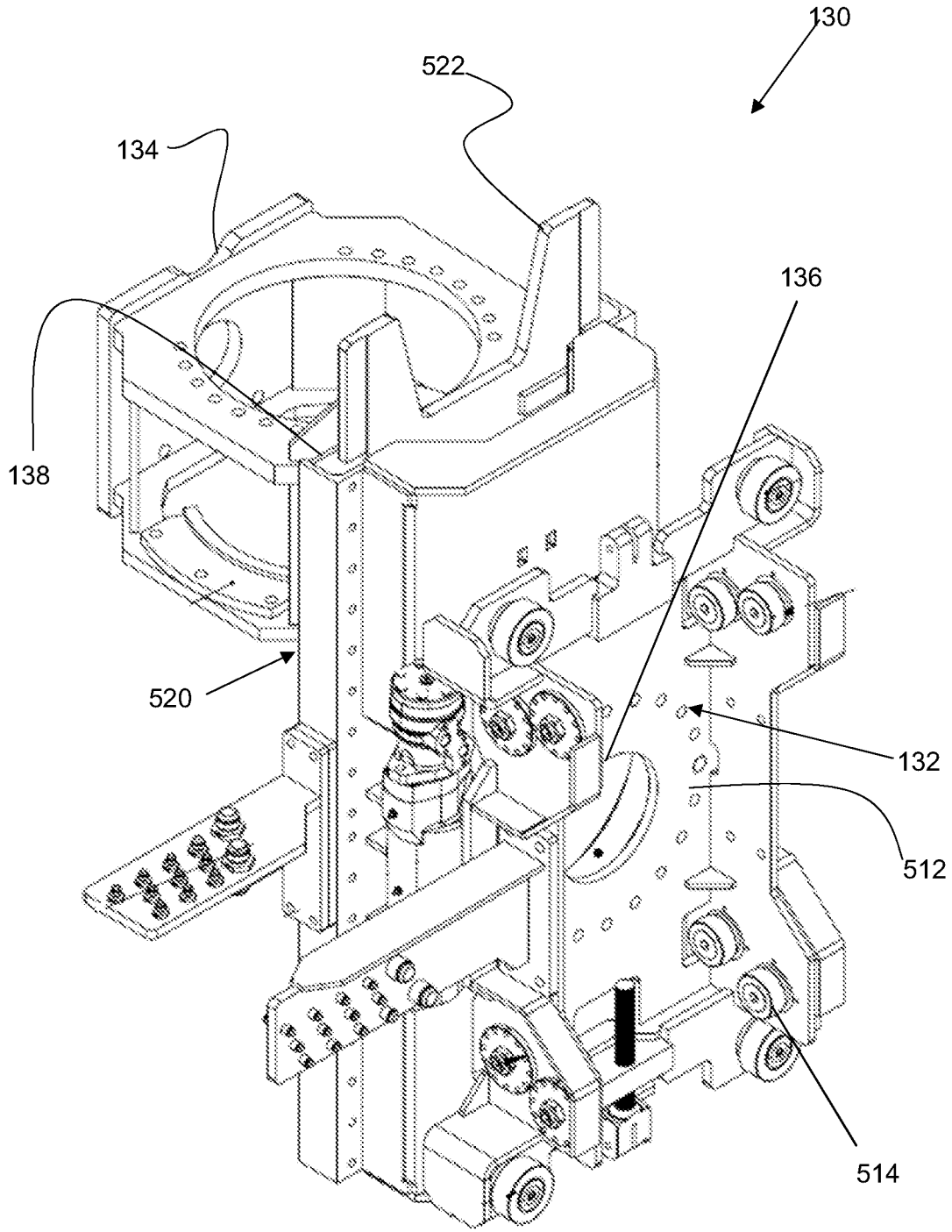
FIG. 6 is an upper perspective showing the carriage and drive assembly of the apparatus as shown in FIGS. 1 to 5

Referring to FIG. 6, the carriage (132) includes a platform (512) which is rotatably coupled to a sliding assembly (520) by the rotational coupling (136). The drive mount (134) is mounted to a sliding platform (522) of the sliding assembly (520).

The platform (512) of the carriage (132) includes a plurality of roller assemblies (514) which are respectively slidably mounted to guide tracks defined on and extending at least partially along a height of the carriage and drive assembly wall (118; not shown) of the mast (110; not shown).

Referring briefly back to FIG. 1, the carriage (132) of the assembly (130) is moved back-and-forth along a height of the mast (110) by an actuating mechanism including a drive chain (not visible) driven by a hydraulic motor.

Figure 2:
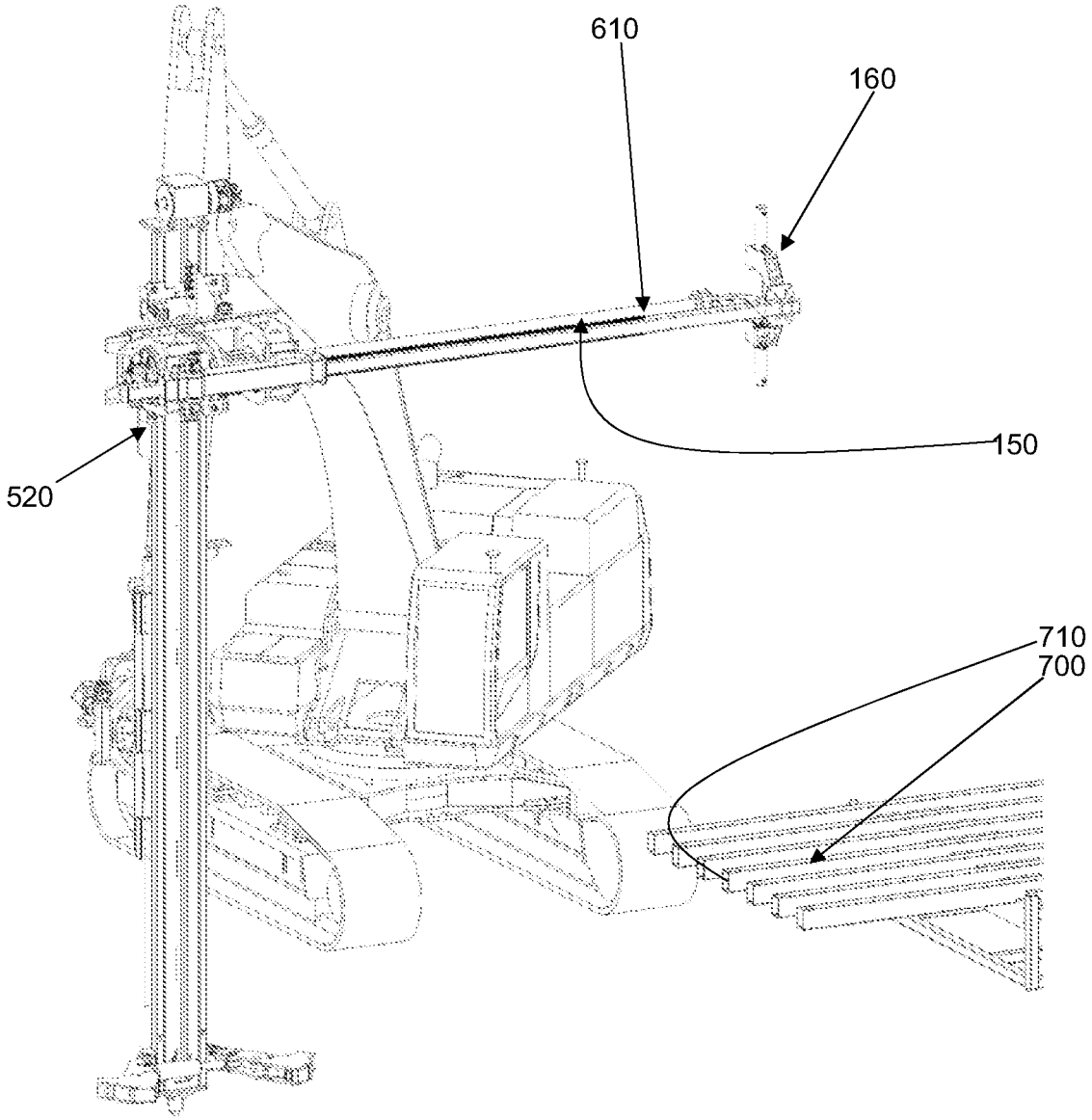
FIG. 2 is a photograph of the pile installation apparatus as shown in FIG. 1 with a drive shaft rotated to a substantially horizontal orientation for mounting a pile thereon.
Figure 3:
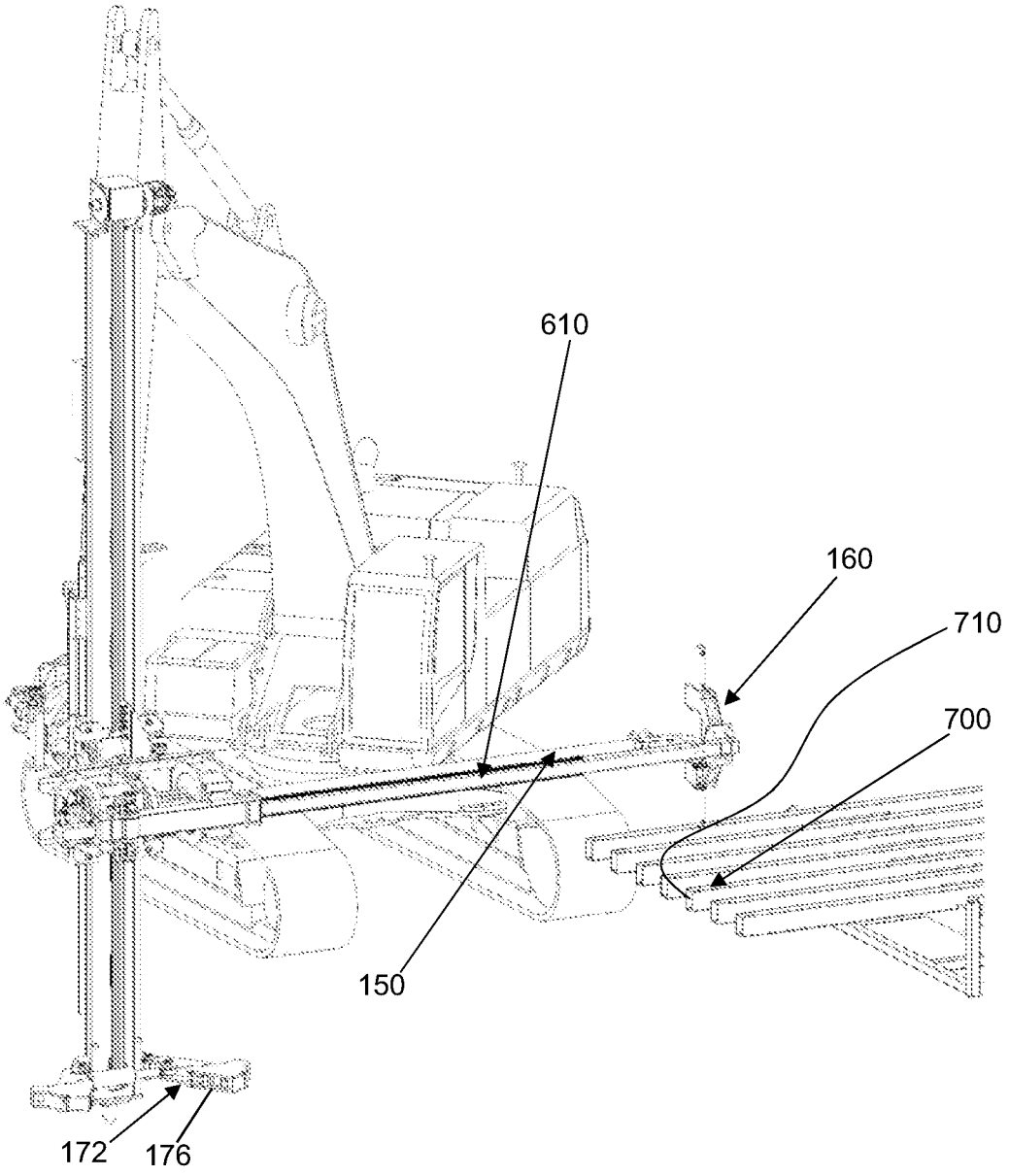
FIG. 3 is a photograph of the pile installation apparatus as shown in FIGS. 1 and 2 with the drive shaft and a clamping assembly being aligned relative to a substantially horizontal pile for loading.

As shown in FIGS. 1 to 3, the rotational coupling (136) enables the sliding assembly (520; shown in FIG. 2 only) and the drive mount (134; and mounted rotational drive (140) and drive shaft (150)) to swivel about a horizontal axis relative to a remainder of the assembly (130) over a range of about 90°.

Like the carriage (132), the rotational coupling (136; not visible) include an actuating mechanism in the form of a hydraulic motor (not visible) for driving rotation relative to the carriage (132).

Referring briefly again to FIG. 6, the drive mount (134) includes one or more brackets for holding and securing a rotational drive (140; not shown) relative to the sliding plate (522) of the sliding assembly (520).

Referring again to FIG. 1, the rotational drive (140) includes a drive motor and a formation (not shown) for releasably engaging with and rotating the drive shaft (150).

The drive motor is a hydraulic motor.

The drive shaft (150) is an elongate member having a pair of opposed ends, including an upper end (not visible) configured to be mountable on the formation for the transmission of torque and an opposed lower end (154) configured to engage with a hub of the pile (700) to thereby in use transmit torque to a lower portion of the pile (700).

Referring again to FIG. 6, the slide assembly (520) enables the drive mount (134) to be slidable relative to a remainder of the carriage and drive assembly (130) between an extended and retracted position.

Advantageously, in use the slide assembly (520) enables the drive shaft (150; not shown) to be extended outwards relative to a remainder of the carriage and drive assembly (130) for loading of a pile (700; not shown) thereon.

The slide assembly (520) enables the drive mount (134) to slide between the extended and retracted positions relative to a remainder of the carriage and drive assembly (130) over a distance of about 600 mm.

The sliding platform (522) of the slide assembly (520) is slidably mounted to a pair of opposed channels (138) provided on a part or portion of the rotational coupling (136).

The slide assembly (520) further includes an actuating mechanism in the form of a hydraulic ram (not shown) for moving the slide platform (522) of the slide assembly (520) between the extended and retracted positions.

Figure 7:
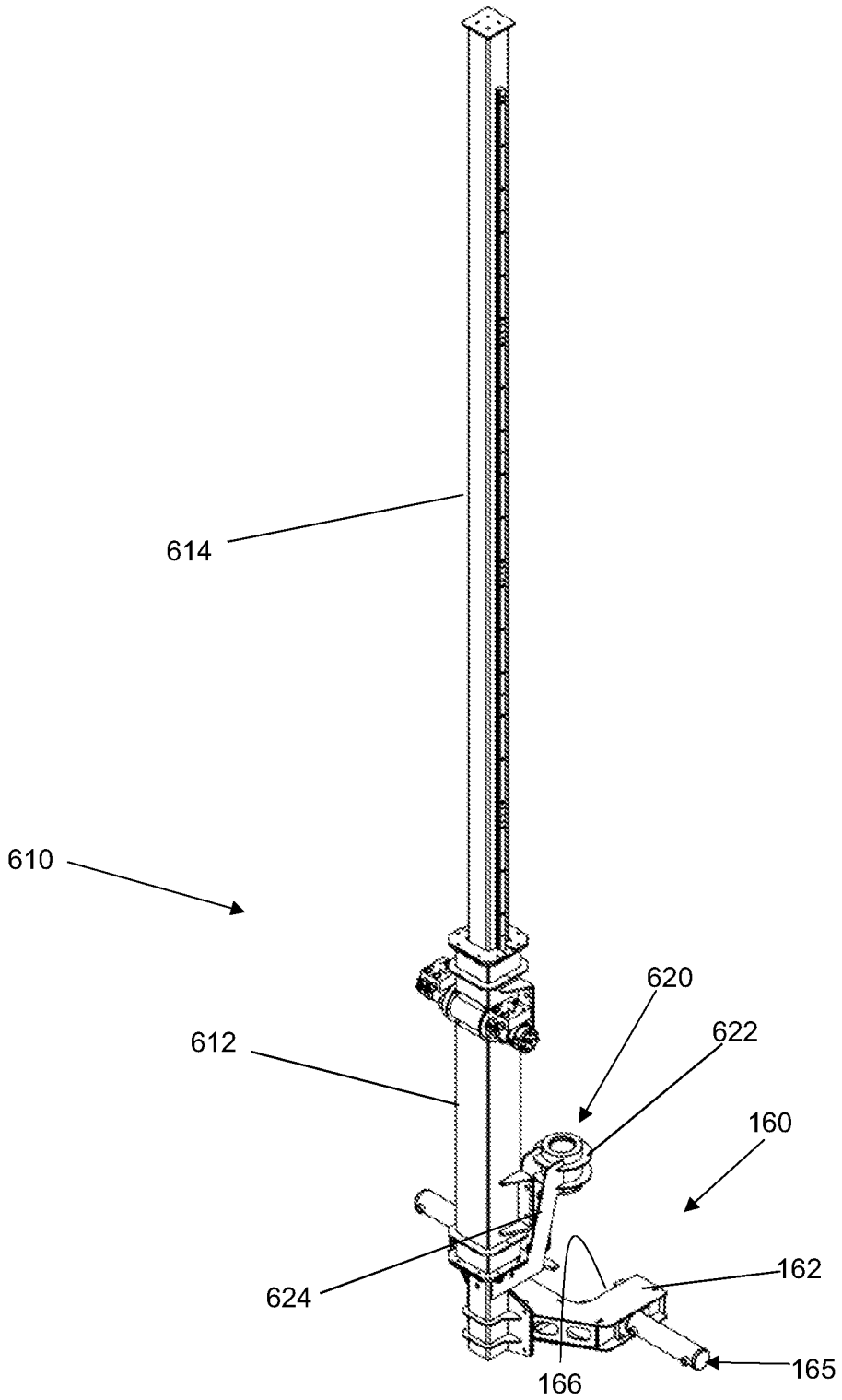
FIG. 7 is an upper perspective view of the clamping assembly and telescopic arm of the apparatus as shown in FIGS. 1 to 5.

Referring to FIG. 7, as indicated, the apparatus (100) include a clamping assembly (160) for clamping about the drive end (710; not shown) of a pile (700; not shown) for mounting onto the drive shaft (150; not shown) and retaining the pile (700; not shown) relative to the drive shaft (150; not shown) at least while the carriage and drive assembly (130; not shown) rotates to the operable position.

The clamping assembly (160) is mounted relative to the drive mount (134; not shown) of the carriage and drive assembly (130; not shown) by a telescopic arm (610).

The clamping assembly (160) includes the pair of opposed clamping members (162), a clamping housing (164) for at least partially housing and holding the clamping members (162) relative to one another and an actuating mechanism in the form of a pair of hydraulic rams (165) for moving the opposed clamping members (162) towards and away from one another.

Each clamping member (162) includes a plate (166) including a clamping surface (168; not shown) sized and shaped to fit at least partially about a periphery of a drive end (710; not shown) of a pile (700; not shown).

The telescopic arm (610) includes an outer telescopic member (612) mounted to the drive mount (134; not shown) and an inner telescopic member (614) configured to be received through and be moveable relative to the outer telescopic member (612) between extended and retracted positions.

The outer telescopic member (612) defines a conduit with a passageway extending therethrough through which the inner telescopic member (614) is received.

The inner telescopic member (614) includes a pair of opposed end and an elongate body extending therebetween in a linear direction.

The clamping assembly (160) is be mounted to a lower end of the inner telescopic member (614) so as to be moveable relative to the drive mount (134; not visible) and the carriage and drive assembly (130; not visible) when the inner telescopic member (614) is slid relative to the outer telescopic member (612).

Referring briefly to FIGS. 2 and 3, the telescopic arm (610) moves to the extended position together with the clamping assembly (160) for receiving and clamping about the drive end (710) of a pile (700) for mounting the pile (700) onto the drive shaft (150). As specifically shown in FIG. 2, in the extended position the telescopic arm (610) moves the clamping assembly (160) beyond a distal end of the drive shaft (150) for guiding and mounting the pile (700) thereon.

Figure 4:
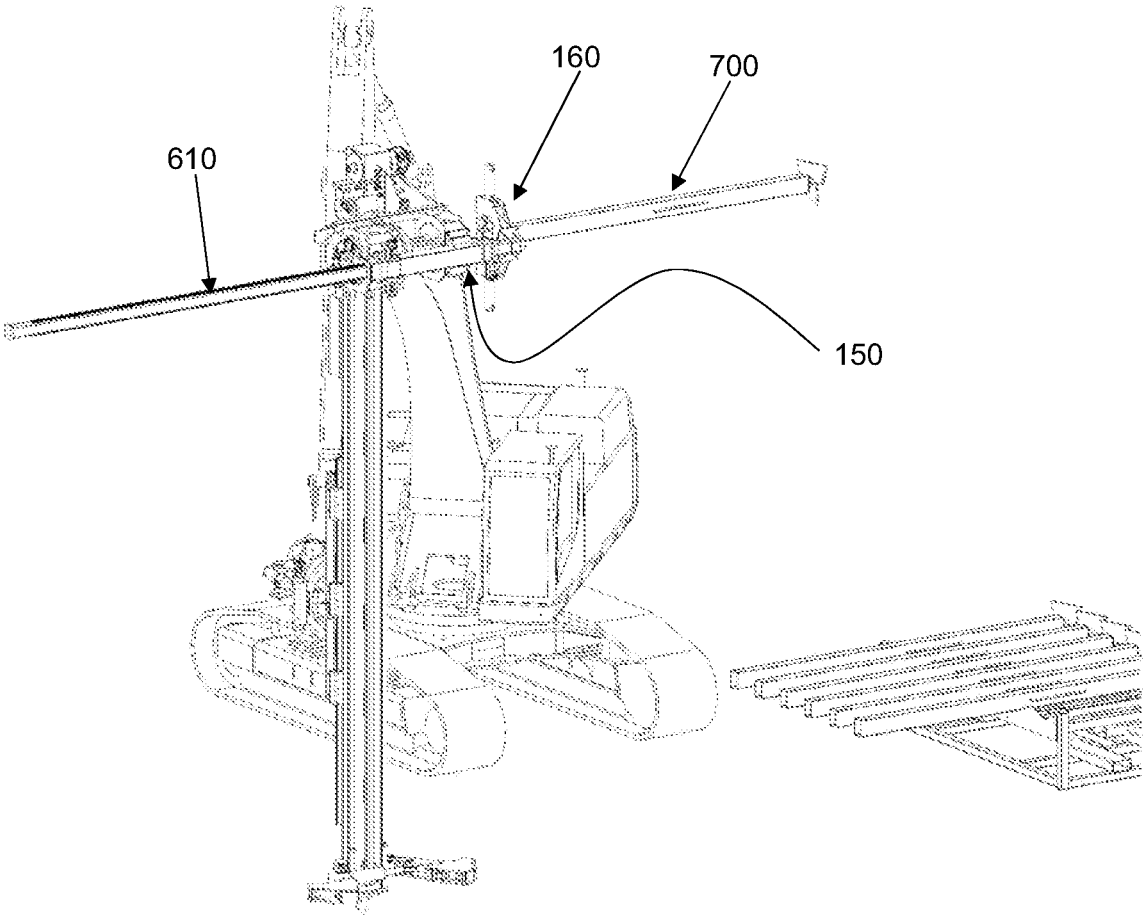
FIG. 4 is a photograph of the pile installation apparatus as shown in FIGS. 1 to 3 with the clamping assembly being retracted via a telescopic arm to pull the pile onto the drive shaft.

Referring briefly to FIG. 4, the telescopic arm (610) then moves to the retracted position together with the clamping assembly (160) and the clamped pile (700) to guide and mount the pile (700) onto the drive shaft (150).

Referring back to FIG. 7, the telescopic arm (610) includes an actuating mechanism in the form of a hydraulically-powered rack-and-pinion mechanism for moving the inner telescopic member (614) and the clamping assembly (160) mounted thereon between the extended and retracted positions.

The clamping assembly (160) and the lower end of the inner telescopic member (614) includes a drive shaft guide (620) mounted thereon for aligning the drive shaft (150; not visible) relative to the clamping assembly (160) and stabilising the drive shaft (150; not visible) when the clamping assembly (160) retracts relative to the drive mount (164) via the telescopic arm (610) to mount a pile (700; not shown) on the drive shaft (150; not shown).

The drive shaft guide (620) extends out from the lower end of the inner telescopic member (614) for aligning the drive shaft (150; not shown) relative to the clamping assembly (160).

The drive shaft guide (620) includes a collar (622) through which the drive shaft (150; not shown) extends and at least one arm (624) extending between the collar (622) and the lower end of the inner telescopic member (614).

The collar (622) includes one or more plain bearings applied on an inner surface thereof to facilitate movement of the drive shaft (150; not shown) therethrough.

Referring to FIG. 5, the apparatus (100) further includes a guide assembly (170) for at least partially enclosing around a periphery of the pile (700) at or near the lower end of the mast (110) and guiding the pile (700) as it is driven into the underlying ground surface.

The guide assembly (170) includes a pair of opposed guide members (172) hingedly connected to the mast (110) and pivotable relative to the mast (110) and an actuating mechanism in the form of a pair of hydraulic ram (174) for moving the guide members (172) towards and away from each other.

In use, the guide assembly (170) is configured to at least partially enclose the pile (700) when driving the pile (700) into the underlying ground surface for guiding the pile (700) relative to the mast (110).

Referring to FIG. 3, each guide member (172) includes a shaped internal guiding surface (176) configured to complementarily fit at least partially about a periphery of the pile (700).

FIGS. 8 to 13 show a second embodiment of the pile installation apparatus (100). For convenience, features that are similar or correspond to features of the first embodiment will be referenced with the same reference numerals.

Figure 8:
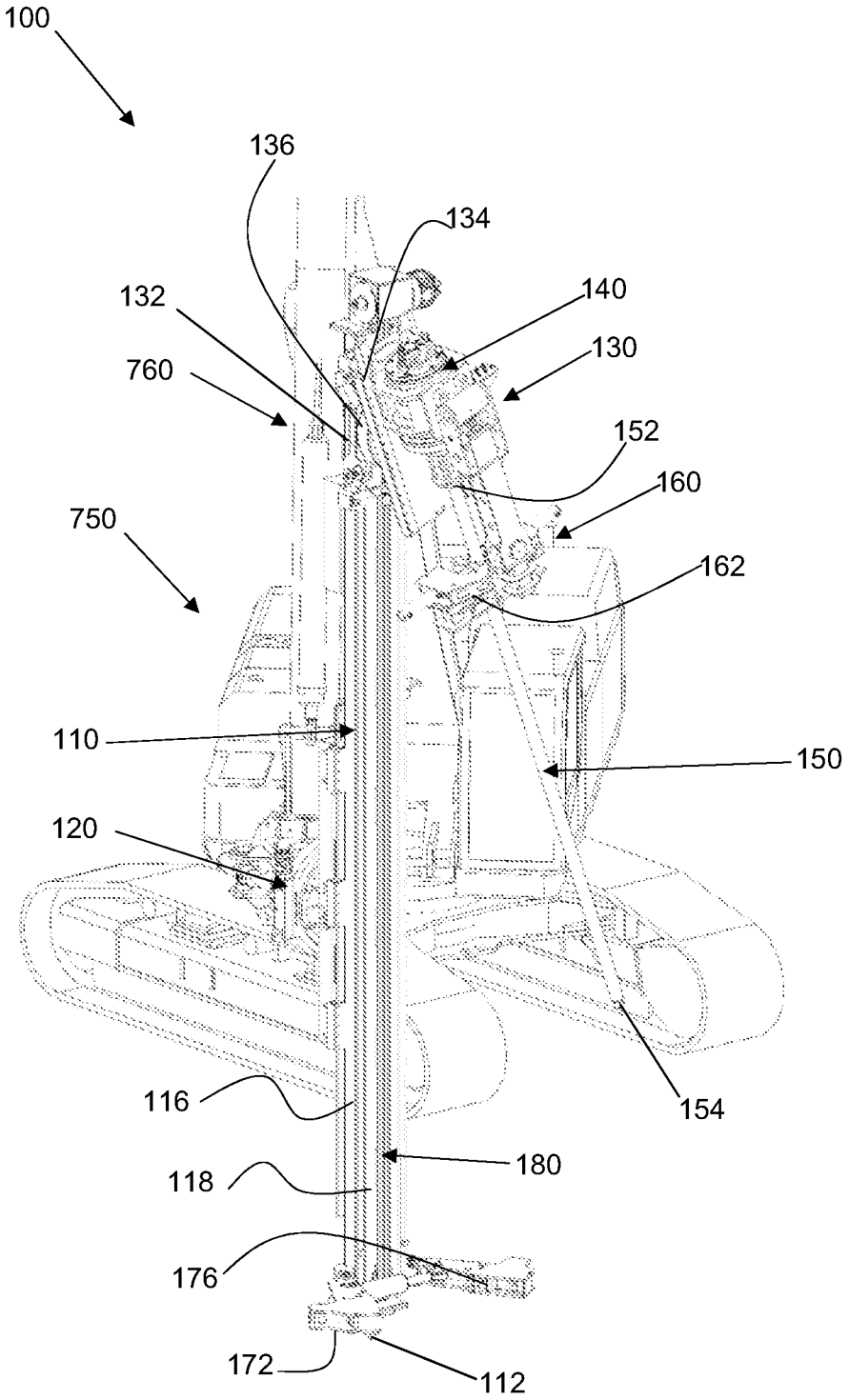
FIG. 8 is a photograph of a pile installation apparatus according to another embodiment of the present invention.

Referring to FIG. 8, the apparatus (100) includes a mast (110) adapted to be arranged in a substantially vertical position above a ground surface; a vehicle mount (120) for mounting the mast (110) to an excavator (750) adapted to raise and lower the mast (110) to and from the substantially vertical position and to otherwise manipulate and transport the mast (110) and apparatus (100); and a carriage and drive assembly (130) slidably mounted to the mast (110) for movement therealong and configured for rotational movement relative to the mast (110), said assembly (130) including a rotational drive (140) and drive shaft (150) for mounting of a drive end (710; not shown) of a screw pile (700; not shown) thereon, said carriage and drive assembly (130) configured to be rotatable relative to the mast (110) between a loading position for loading a non-vertically oriented pile (700; not shown) onto the drive shaft (150) and an operable position for driving the pile (700; not shown) into an underlying ground surface.

The apparatus (100) again includes a clamping assembly (160) including a pair of opposed clamping members (162) for clamping the drive end (710; not visible) of the pile (700; not shown) and retaining the pile (700; not shown) relative to the drive shaft (150) at least while the carriage and drive assembly (130) rotate to the operable position; and a guide assembly (170) including a pair of opposed guide members (172) for at least partially enclosing around a periphery of the pile (700; not shown) at or near the lower end of the mast (110) and guiding the pile (700; not shown) as it is driven into the underlying ground surface.

As indicated, the carriage and drive assembly (130) is slidably mounted to the mast (110) for movement therealong and configured for rotational movement relative to the mast (110).

The assembly (130) includes a carriage (132) configured to be slidably mountable to the mast (110) and a drive mount (134) rotatably coupled to the carriage (132) by a rotational coupling (136) for mounting the rotational drive (140) with operable drive shaft (150).

The carriage (132) of the assembly (130) is moved back-and-forth along a height of the mast (110) by an actuating mechanism including a drive chain (180) driven by a hydraulic motor.

Figure 9:
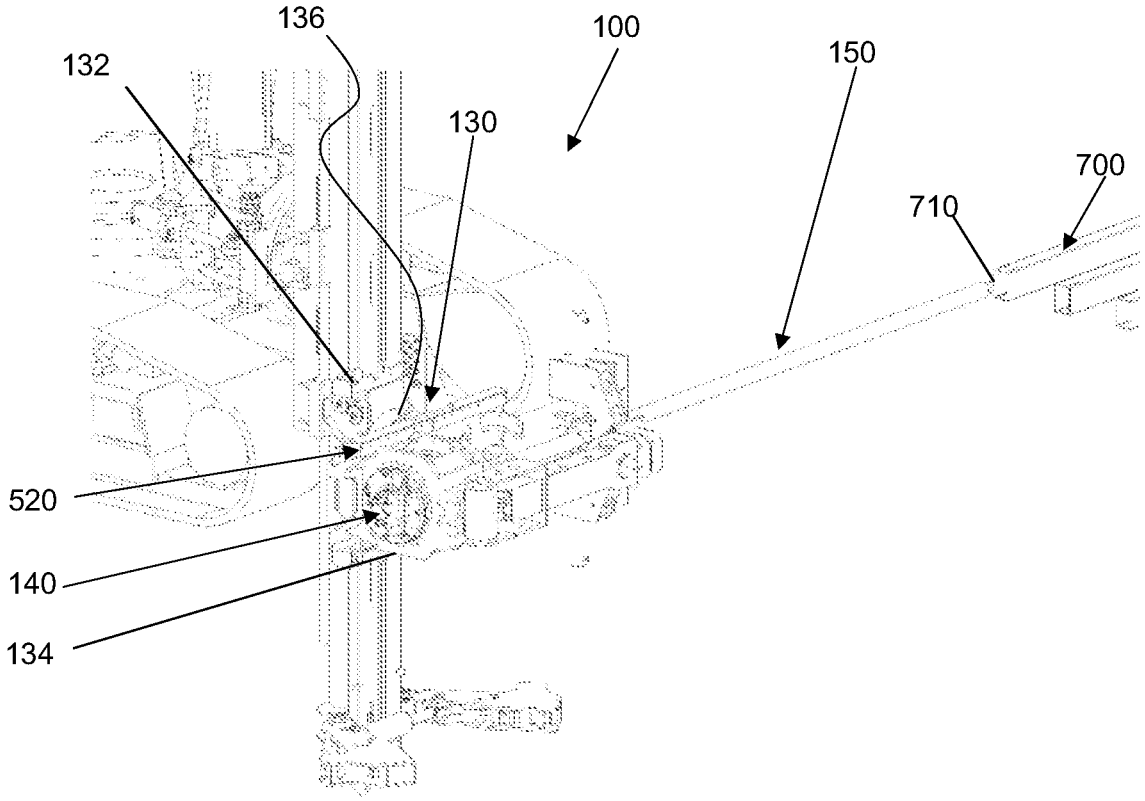
FIG. 9 is photograph of the apparatus as shown in FIG. 8 being aligned relative to a substantially horizontal pile for loading.
Figure 10:
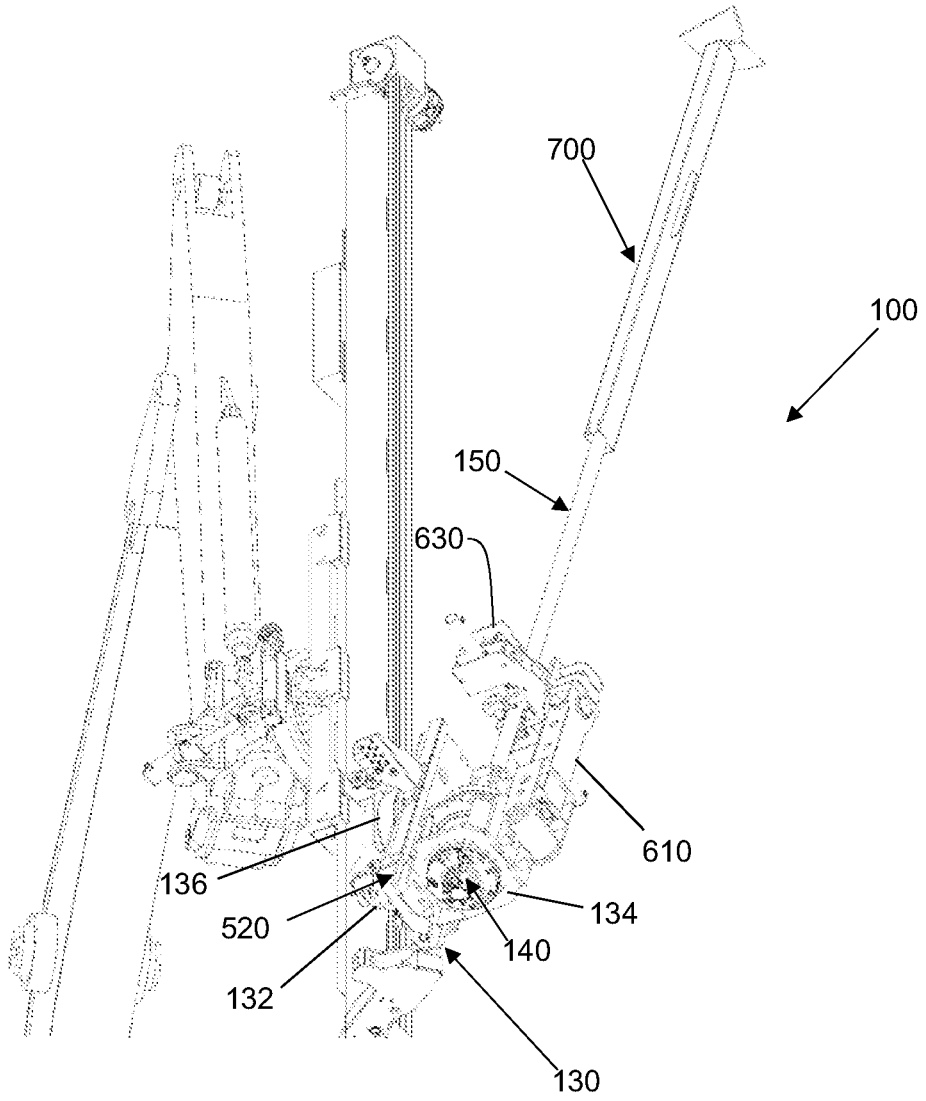
FIG. 10 is a photograph of the apparatus as shown in FIGS. 8 and 9 with the pile partially mounted on a drive shaft of the apparatus.

As shown in FIGS. 8 to 10, the rotational coupling (136) enables the drive mount (134; and mounted rotational drive (140) and drive shaft (150)) to swivel about a horizontal axis relative to a remainder of the assembly (130) over a range of about 170°.

Like the carriage (132), the rotational coupling (136) include an actuating mechanism in the form of a hydraulic motor (not visible) for driving rotation relative to the carriage (132).

Referring to FIG. 8, the rotational drive (140) includes a drive motor and a formation (not shown) for releasably engaging with and rotating the drive shaft (150).

The drive motor is a hydraulic motor.

The drive shaft (150) is an elongate member having a pair of opposed ends, including an upper end (152) configured to be mountable on the formation for the transmission of torque and an opposed lower end (154) configured to engage with a hub of the pile (700; not shown) to thereby in use transmit torque to a lower portion of the pile (700; not shown).

Figure 13:
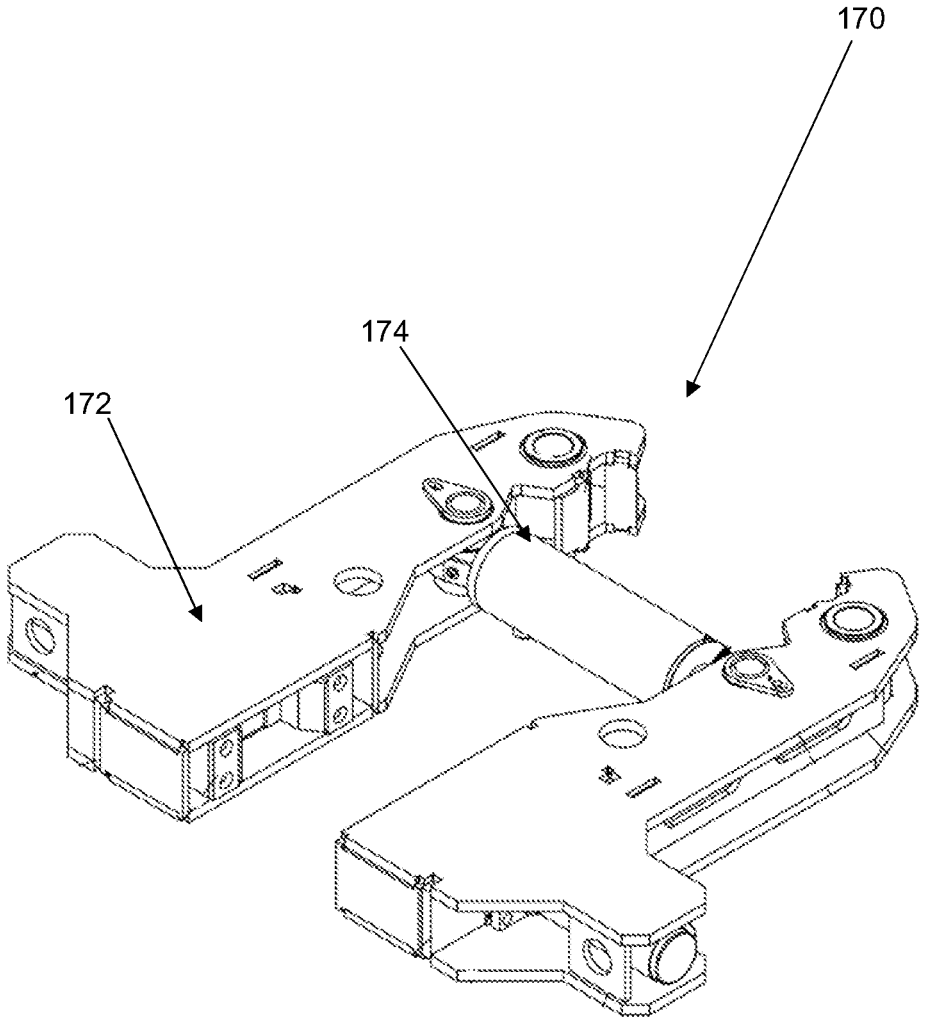
FIG. 13 is a perspective view showing part of a guide assembly of the apparatus as shown in FIGS. 8 to 11.

Referring to FIG. 13, and as indicated, the apparatus (100) includes a clamping assembly (160) for clamping about the drive end (710; not shown) of a pile (700; not shown) and retaining the pile (700; not shown) relative to the drive shaft (150; not shown) while the carriage and drive assembly (130; not shown) rotates to the operable position and while the pile (700; not shown) is driven into an underlying ground surface.

The clamping assembly (160) is mounted relative to the drive mount (134; not shown) of the carriage and drive assembly (130; not shown) by a telescopic arm (610).

The clamping assembly (160) includes the pair of opposed clamping members (162), a clamping housing (164) for at least partially housing and holding the clamping members (162) relative to one another and an actuating mechanism in the form of a hydraulic ram (not shown) for moving the opposed clamping members (162) towards and away from one another.

Each clamping member (162) includes a plate (166) including a clamping surface (168) sized and shaped to fit at least partially about a periphery of a drive end (710); not shown) of a pile (700; not shown).

The clamping assembly (160) further includes a pair impact plates (630) and dampers (640) for damping an impact of a pile (700; not shown) when it is partially inverted and slidably mounted onto the drive shaft (150; not shown) under the force of gravity, as shown in FIG. 10.

The impact plates (630) are mounted on a lower surface of the clamping housing (164) facing a distal end of the drive shaft (150; not shown).

Each damper (640) is located between a respective impact plate (630) and the lower face for damping a force of the impact (of the pile). Each damper (640) includes a rubber damper, i.e., a rubber buffer.

Referring briefly to FIG. 10, the telescopic arm (610), in use, advantageously moves to the extended position for positioning the impact plates (630) and dampers (640; not visible) in front of the carriage and drive assembly (130) for receiving the pile (700) thereon when mounting the pile (700) onto the drive shaft (150).

The telescopic arm (610) then moves to the retracted position together with the clamping assembly (160) and the pile (700) to guide the pile (700) fully onto the drive shaft (150).

Like the clamping assembly (160), the telescopic arm (610) includes an actuating mechanism in the form of a hydraulic ram for moving the arm (610) between the extended and retracted positions.

Referring to FIG. 13, the apparatus (100) further includes a guide assembly (170) for at least partially enclosing around a periphery of the pile (700; not shown) at or near the lower end of the mast (110; not shown) and guiding the pile (700; not shown) as it is driven into the underlying ground surface.

The guide assembly (170) includes a pair of opposed guide members (172) hingedly connected to the mast (110; not shown) and pivotable relative to the mast (110; not shown) and an actuating mechanism in the form of a hydraulic ram (174) for moving the guide members (172) towards and away from each other.

In use, the guide assembly (170) is configured to at least partially enclose the pile (700; not shown) when driving the pile (700; not shown) into the underlying ground surface for guiding the pile (700; not shown) relative to the mast (110; not shown).

Referring back to FIG. 8, each guide member (172) includes a shaped internal guiding surface (176) configured to complementarily fit at least partially about a periphery of the pile (700; not shown).

Figure 14:
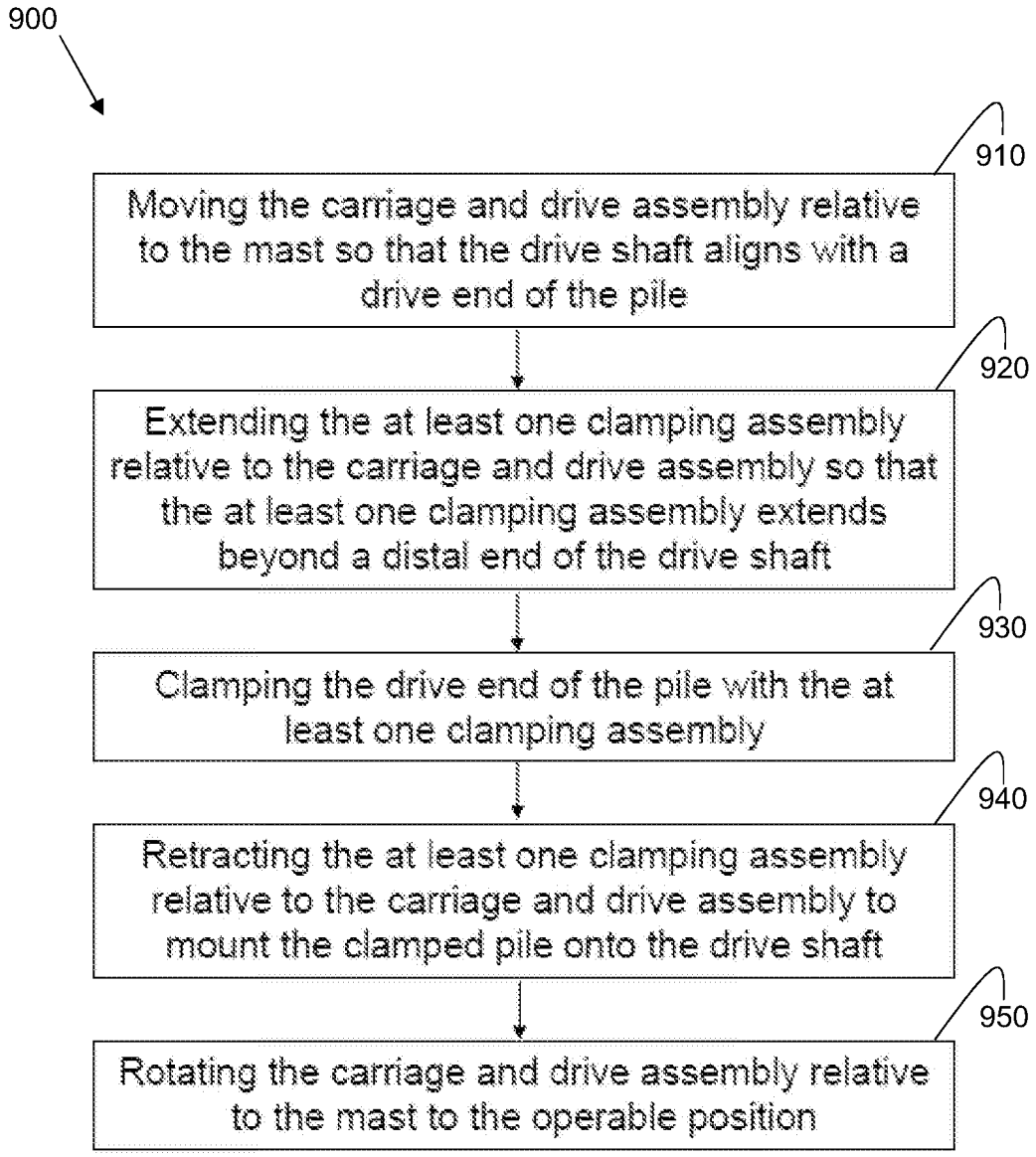
FIG. 14 is a flowchart showing steps in a method of loading a pile relative to the apparatus as shown in FIGS. 1 to 5.

A method (900) of using the apparatus (100) as shown in FIGS. 1 to 5 is now described in detail with reference to FIG. 14.

At step 910 and as shown in FIGS. 1 to 3, the carriage and drive assembly (130) is moved relative to the mast (110) to align the drive shaft (150) relative to a drive end (710) of the pile (700).

At step 920 and as shown in FIG. 2, the clamping assembly (160) is slid relative to the carriage and drive assembly (130) by way of the telescopic arm (610) until the clamping assembly (160) is extended beyond a distal end of the drive shaft (150).

At step 930, the drive end (710) of the pile (700) is clamped by the clamping assembly (160).

At step 940, and as shown in FIG. 4, the clamping assembly (160) is retracted relative to the carriage and drive assembly (130) by way of the telescopic arm (610) to mount the clamped pile (700) fully onto the drive shaft (150).

At step 950, and as shown in FIG. 5, the carriage and drive assembly (130) rotates the drive shaft (150) with the pile (700) mounted thereon to the operable position.

Figure 15:
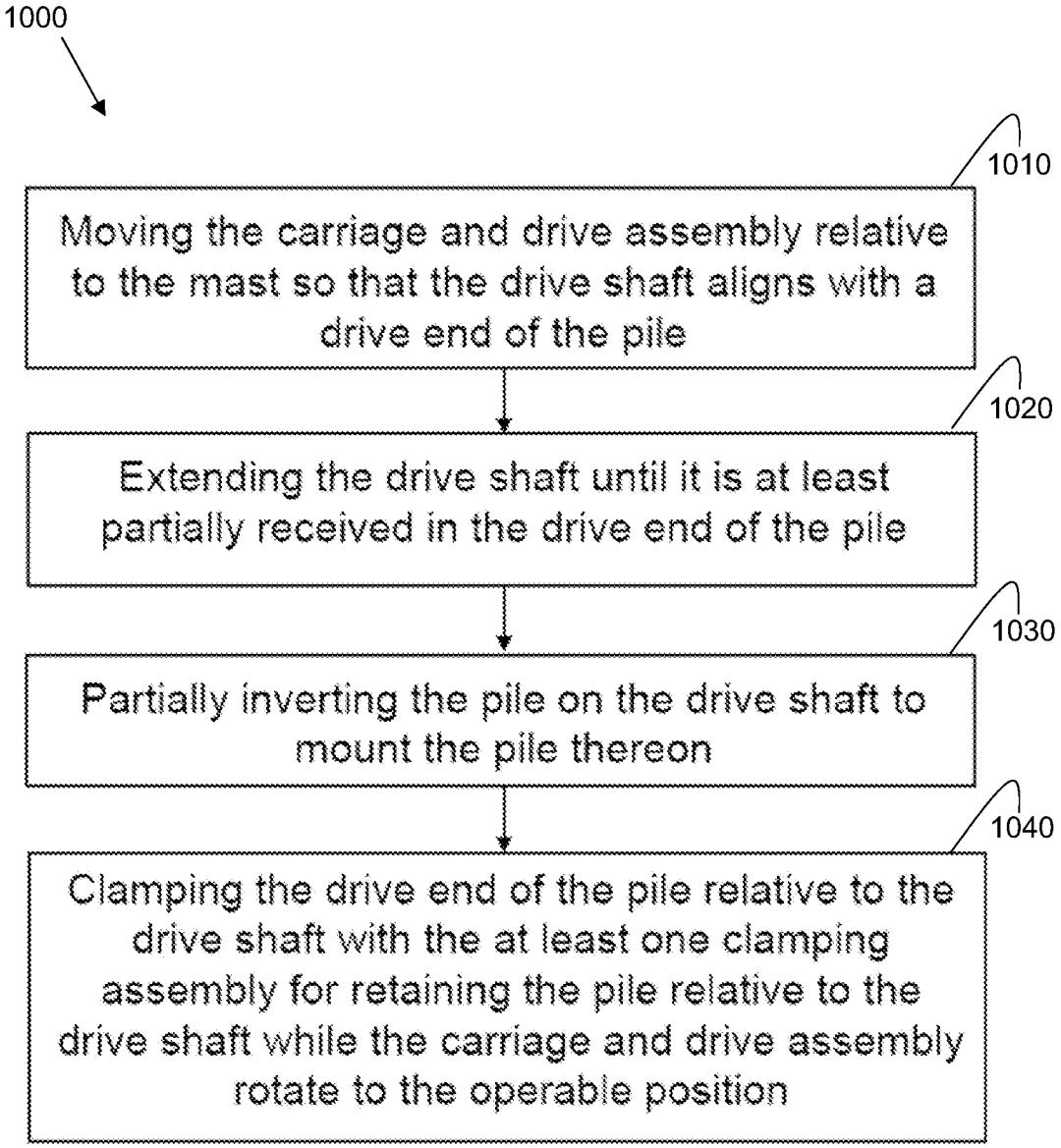
FIG. 15 is a flowchart showing steps in a method of loading a pile relative to the apparatus as shown in FIGS. 8 to 11.

A method (1000) of using the apparatus (100) as shown in FIGS. 8 to 11 is now described in detail with reference to FIG. 15.

At step 1010 and as shown in FIGS. 1 and 2, the carriage and drive assembly (130) is moved relative to the mast (110) to align the drive shaft (150) relative to a drive end (710; shown only in FIG. 9) of the pile (700; shown only in FIG. 9).

At step 1020 and as shown in FIG. 9, the rotational drive (140) and drive shaft (150) is slid relative to the carriage (132) of the carriage and drive assembly (130) to slide the distal end of the drive shaft (150) at least partially into the drive end (710) of the pile (700) and partially mount the pile (700) relative to the drive shaft (150).

Figure 11:
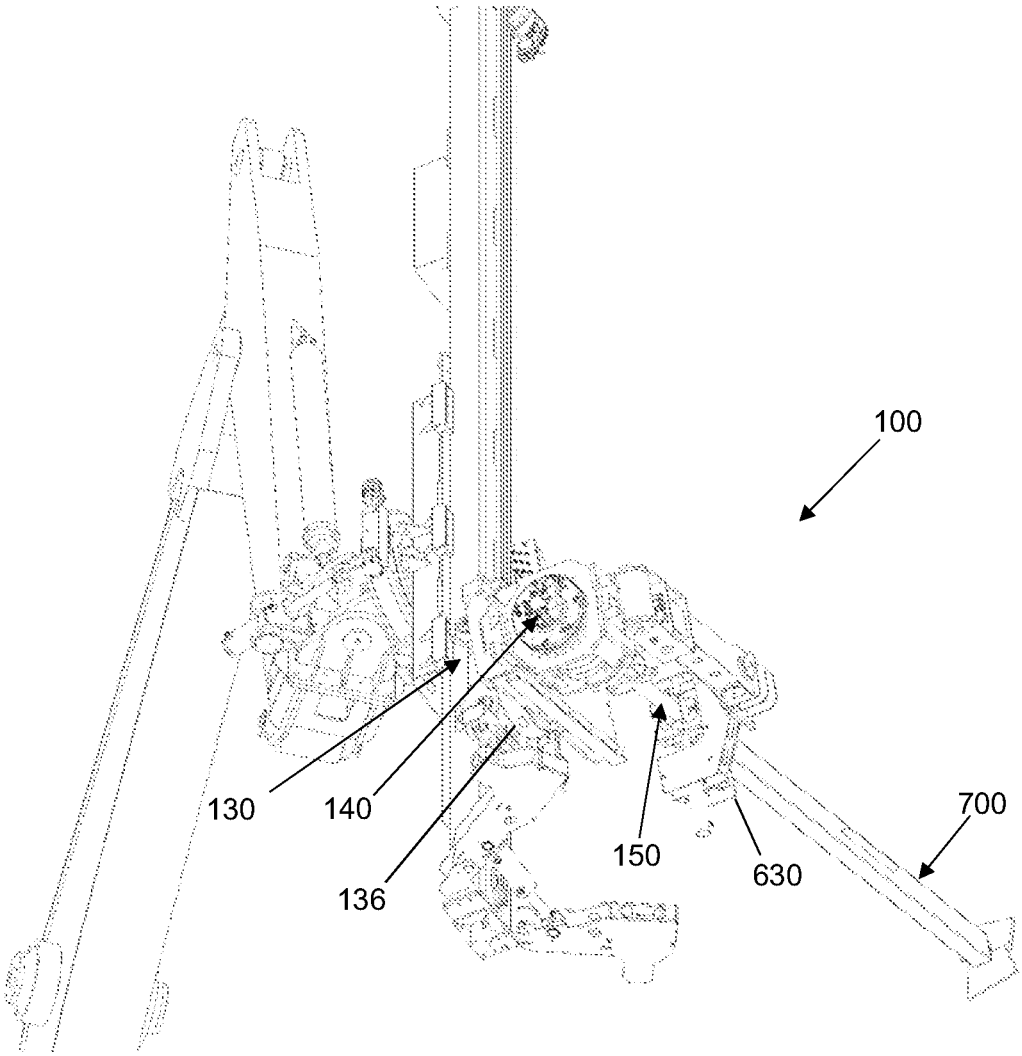
FIG. 11 is a photograph of the apparatus as shown in FIGS. 8 to 10 with the pile now substantially mounted on the drive shaft.
Figure 12:
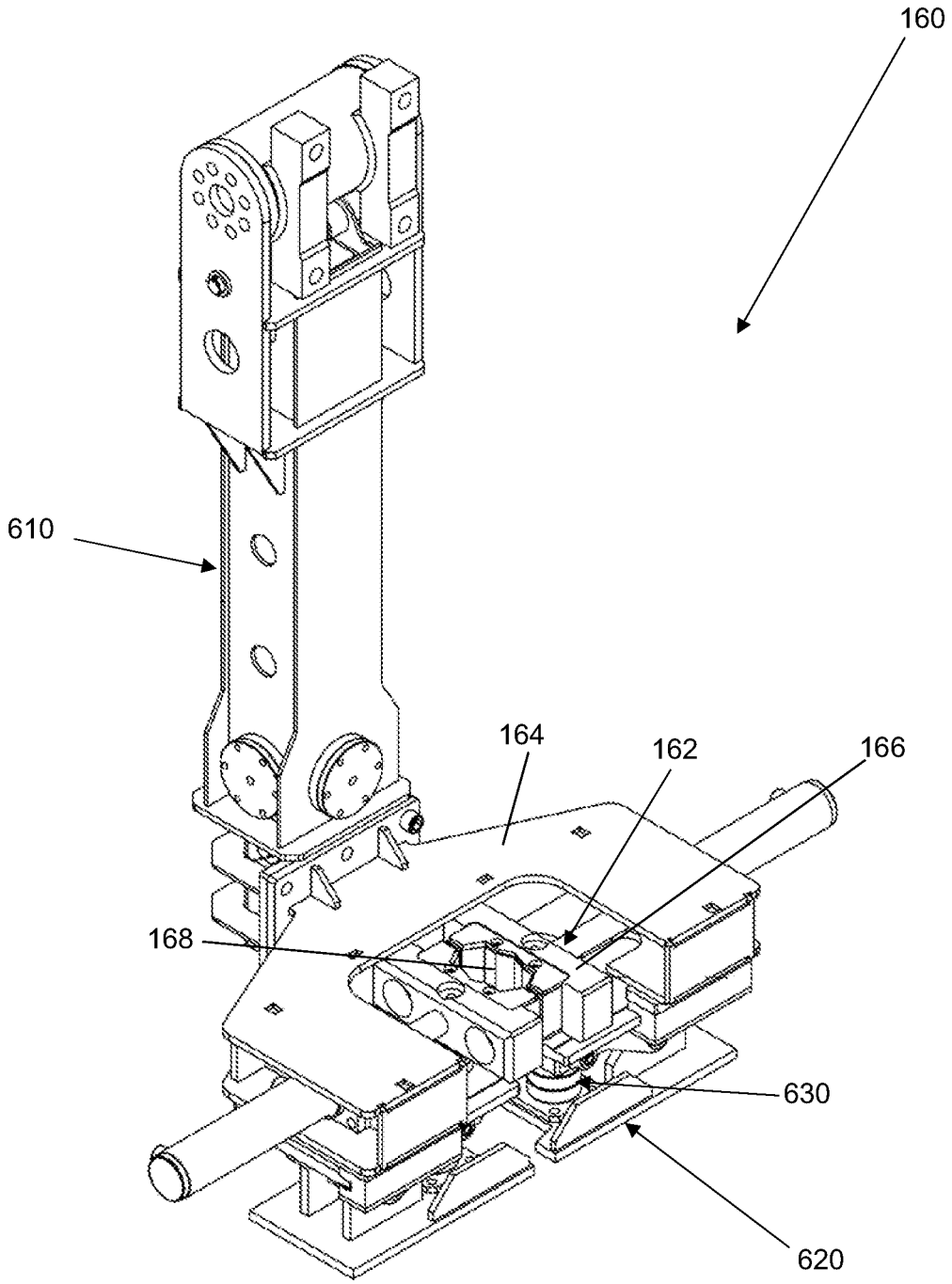
FIG. 12 is a perspective view showing a clamping assembly of the apparatus as shown in FIG. 8 to 11.

At step 1030 and with reference to FIG. 10, the rotational drive (140) and drive shaft (150) of the carriage and drive assembly (130) are rotated by way of the rotational coupling (136) to partially invert the pile (700) partially mounted on the drive shaft (150) and cause the pile (700) to slidably mount on a remainder of the drive shaft (150), as shown in FIG. 11.

As also shown, the plates (630) and dampers (640; not visible) are positioned between the rotational drive (140) and the pile (700) for damping the impact of the pile (700) as it slides under the force of gravity substantially onto the drive shaft (150).

At step 1040, the clamping members (162) of the clamping assembly (160) clamp about drive end (710) of the pile (700) to retain the pile (700) relative to the drive shaft (150) while the carriage and drive assembly (130) rotates the drive shaft (150) with pile (700) mounted thereon to the operable position.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A pile installation apparatus for loading and installing a pile into an underlying ground surface, said apparatus comprising:

a mast adapted to be arranged in a substantially vertical position above the ground surface;

a vehicle mount for mounting the mast to a support vehicle adapted to raise and lower the mast to and from the substantially vertical position and to otherwise manipulate and transport the mast;

a carriage and drive assembly slidably mounted to the mast for vertical movement therealong and configured for rotational movement relative to the mast, said assembly comprising a rotational drive and drive shaft for mounting of a drive end of the pile thereon, a carriage configured to be slidably mountable to the mast, a drive mount rotatably coupled by a rotational coupling to the carriage for mounting the rotational drive and the drive shaft thereon and a slide assembly located between the rotational coupling and the drive mount for enabling the drive mount to be slidable relative to the carriage between an extended position and a retracted position, said carriage and drive assembly configured to be rotatable relative to the mast between a loading position for loading a non-vertically oriented pile onto the drive shaft and an operable position for driving the pile into the underlying ground surface; and at least one clamping assembly comprising a pair of opposed clamping members for clamping the drive end of the pile and retaining the pile relative to the drive shaft at least while the carriage and drive assembly rotates to the operable position.

2. The apparatus of claim 1, wherein the pile is a screw pile.

3. The apparatus of claim 1, wherein the carriage comprises a platform to which the drive mount is rotatably coupled.

4. The apparatus of claim 3, wherein the carriage comprises one or more roller assemblies and the mast comprises at least one guide track extending at least partially along a height of the mast for guiding passage of the roller assemblies of the carriage therealong.

5. The apparatus of claim 1, wherein the at least one clamping assembly is operatively associated with the carriage and drive assembly for clamping onto the drive end of the pile for mounting onto the drive shaft.

6. The apparatus of claim 5, wherein the at least one clamping assembly is mounted to the drive mount of the carriage and drive assembly via a telescopic arm.

7. The apparatus to claim 6, wherein the telescopic arm is configured to be moveable between an extended and a retracted position relative to the drive mount so as to enable the clamping assembly to retrieve and mount the pile onto the drive shaft.

8. The apparatus of claim 7, wherein the telescopic arm comprises an outer telescopic member mounted to the drive mount and inner telescopic member configured to be received through and be moveable relative to the outer telescopic member between the extended and retracted positions.

9. The apparatus of claim 8, wherein inner telescopic member comprises a pair of opposed ends and a linear body extending therebetween, the at least one clamping assembly is mounted on one of the opposed ends so as to be moveable relative to the drive mount when the inner telescopic member is slid relative to the outer telescopic member.

10. The apparatus of claim 7, wherein, when in the extended position, the telescopic arm is configured to move the at least one clamping assembly beyond a distal end of the drive shaft for retrieving, guiding and mounting the pile on the drive shaft.

11. The apparatus of claim 6, further comprising a drive shaft guide operatively associated with the telescopic arm for aligning the drive shaft relative to the at least one clamping assembly, when the clamping assembly retracts relative to the drive mount via the telescopic arm to mount the pile on the drive shaft.

12. The apparatus of claim 11, wherein the drive shaft guide comprises a collar through which the drive shaft extends through and at least one arm extending between the collar and the telescopic arm.

13. The apparatus of claim 1, further comprising at least one guide assembly for at least partially enclosing around a periphery of the pile at or near a lower end of the mast for guiding the pile as it is driven into the underlying ground surface.

14. A method of loading a non-vertically oriented pile resting in a rack or atop a trailer with an apparatus according to claim 1, said method comprising:

moving the carriage and drive assembly relative to the mast so that the drive shaft aligns with a drive end of the pile;

extending the at least one clamping assembly relative to the carriage and drive assembly so that the at least one clamping assembly extends beyond a distal end of the drive shaft;

clamping the drive end of the pile with the at least one clamping assembly;

retracting the at least one clamping assembly relative to the carriage and drive assembly to mount a clamped said pile onto the drive shaft; and rotating the carriage and drive assembly relative to the mast to the operable position.

15. The method of claim 14, wherein the moving comprises sliding the carriage of the carriage and drive assembly along the mast and the rotating the drive mount to align the drive shaft relative to the drive end of the pile.

16. The method of claim 14, wherein the clamping comprises actuating clamping member of the at least one clamping assembly to clamp about the drive end of the pile.

17. The method of claim 14, wherein the retracting retrieves a clamped said pile and mounts the pile onto the drive shaft.

* * * * *